United States Patent [19]

Tellman

[11] 4,266,382

[45] May 12, 1981

[54] HARDBOARD PANEL SIDING

[75] Inventor: Stephen J. Tellman, Patterson, N.Y.

[73] Assignee: Champion International Corporation, Stamford, Conn.

[21] Appl. No.: 40,177

[22] Filed: May 18, 1979

[51] Int. Cl.[3] ..... E04D 1/00

[52] U.S. Cl. ..... 52/316; 52/314; 52/539

[58] Field of Search ..... 52/316, 313, 314, 539, 52/592, 595, 593

[56] References Cited

U.S. PATENT DOCUMENTS

| | | | |
|---|---|---|---|
| 517,521 | 4/1894 | Hensel | 52/316 |
| 2,075,676 | 3/1937 | Toney | 52/316 |
| 2,114,450 | 4/1938 | Maclean | 52/314 |
| 3,087,577 | 4/1963 | Prestian | 52/316 |

FOREIGN PATENT DOCUMENTS

| | | | |
|---|---|---|---|
| 1569989 | 4/1969 | France | 52/595 |
| 240737 | 6/1946 | Switzerland | 52/539 |
| 156251 | 5/1922 | United Kingdom | 52/316 |

OTHER PUBLICATIONS

Examiner's Sketch–2/13/80.

*Primary Examiner*—Price C. Faw, Jr.
*Assistant Examiner*—Henry E. Raduazo
*Attorney, Agent, or Firm*—Evelyn M. Sommer

[57] ABSTRACT

Disclosed is an exterior grade hardboard siding panel which gives the appearance of vertically-applied solid lumber planks having a bead and cove detail. The front surface of the panel has a plurality of adjacent areas which each simulate a vertical solid wood plank. Each of these areas has a cove recess at one edge and a bead adjacent to a cove at the opposite edge. The areas are arranged with the cove of one area and the cove adjacent to the bead of an adjacent area, both facing the bead. The coves are separated from the bead by narrow grooves which provide good breaking points in the design and added damage resistance at the edges of the panels which are joined with shiplap joints.

1 Claim, 3 Drawing Figures

HARDBOARD PANEL SIDING

BACKGROUND OF THE INVENTION

The present invention relates to exterior siding, and more particularly to hardboard siding configured to give the appearance of vertical solid wood planks with decorative edge details.

The art has recognized that it is possible to achieve considerable savings in both labor and materials by employing hardboard siding panels in place of conventional solid wood planks. Prior art panels of this type have been produced with a variety of surface effects, including horizontal lap siding, vertical board and batten siding, and simulated cedar shake siding. Among the variations of horizontal lap siding which have been available are various lap sidings including straight edge and colonial edge beaded lap siding. There are currently a wide variety of panels available with both smooth and textured facings.

Because one of the main advantages of hardboard panel siding is its substantial surface area in a relatively thin sheet, damage to the edges of the panels has heretofore been a problem. It has been possible to control damage by effective packaging, a critical requirement for panels with edges configured to form shiplap joints. There is a difficulty, however, in providing good resistance to edge damage in panels having anything but the simplest shiplap edge configurations. Thus, where detailed surface designs, especially those of a vertical nature such as the simulation of solid wood planks having an edge detail, are desired it is difficult to provide a realistic simulation of the intended design and at the same time provide adequate damage resistance at the edges.

SUMMARY OF THE INVENTION

It is an object of the present invention to provide exterior grade hardboard siding panels which provide the appearance of a multiplicity of vertically-applied solid lumber planks having a bead and cove detail and which are mateable to form a surface, wherein the mating area between the panels is virtually indistinguishable from the individual areas on the panel which define the planks.

Another object of the present invention is to provide an exterior grade of hardboard siding panel which provides the appearance of a multiplicity of vertically-applied lumber planks having a bead and cove detail wherein the design is modified slightly at the shiplap edge to provide added resistance to damage during transport and handling.

These and other objects are accomplished according to the present invention which provides an exterior grade hardboard siding panel for application to vertical surfaces to protect the surfaces from the weather and to provide the appearance of a multiplicity of vertically-applied solid lumber planks having a bead and cove detail, comprising a thin rectangular panel having: (a) a front surface configured with a plurality of adjacent areas each simulating a vertical solid wood plank, wherein each area has a shallow cove recess at one edge and a like cove recess adjacent to a bead at the opposite edge, and said plurality of areas are arranged such that (i) the cove recess of one edge of one area and the cove recess adjacent to the bead of the next adjacent area have their recessed surfaces facing said bead of said next adjacent area, (ii) both said coves are separated from said bead by narrow grooves, and (iii) said bead extends upwardly from the base of said grooves to a crest which is approximately tangential to the outermost plane of the front surface; (b) a substantially planar back surface; (c) a first edge of reduced thickness forming the bottom lap of a shiplap joint, the back surface of which is a continuation of said substantially planar back surface, and the front surface of which is recessed to a level below the base of a groove which terminates the front surface configuration directly adjacent to the recessed area; and (d) a second edge of reduced thickness opposite said first edge, forming the top lap of shiplap joint, the back surface of which is recessed from said substantially planar back surface, and the front surface of which is a substantially continuation of the front surface configuration and terminates with a recessed cove.

BRIEF DESCRIPTION OF THE DRAWINGS

The invention will become better understood and the advantages will become more apparent in view of the following detailed description, especially when read in connection with the attached drawings, wherein.

DETAILED DESCRIPTION OF THE INVENTION

The panels provided according to the present invention are exterior grade hardboard siding panels which have as their primary utility the application to vertical surfaces on the exterior of building structures to protect the surfaces from the weather. While this is the primary purpose of panels of this type, it is well recognized that they can also be employed on horizontal surfaces, especially for soffit applications, as well as purely decorative applications where protection from weathering is not essential. These panels may also be employed as substitutes for interior paneling. The panels comprise thin rectangular sheets which are typically four feet in width and from 7 to 16 feet in length. However, the present invention is not restricted to these particular outside dimensions. It is considered important, however, that the panels be relatively thin. Typically, exterior siding panels of this type will have thicknesses ranging from about $\frac{3}{8}$ of an inch to $\frac{1}{2}$ of an inch. It is within the contemplation of the present invention to form panels of thicknesses ranging from $\frac{1}{4}$ inch to about $\frac{3}{4}$ of an inch.

Figure 1:
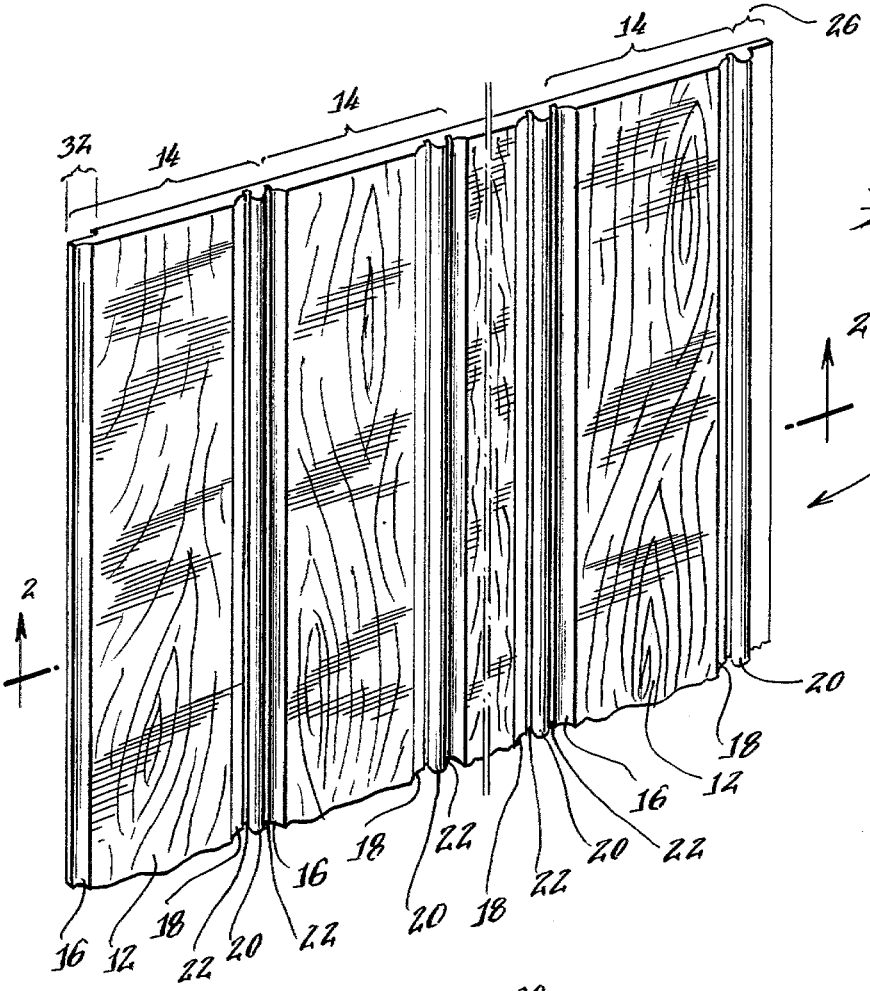
FIG. 1 is a perspective view of a hardboard siding panel according to the present invention, being partially broken away at the lower edge and in a longitudinal central portion.
Figure 2:
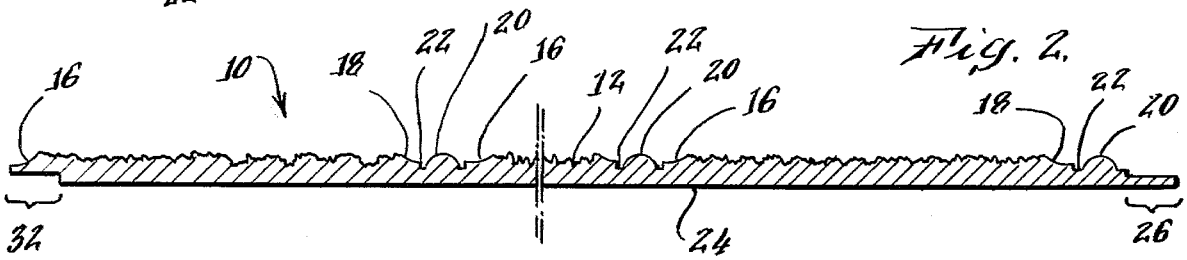
FIG. 2 is a cross section taken along line 2—2 in FIG. 1.

A panel is shown generally as 10 in FIG. 1 to have a plurality of areas 12 which provide the appearance of a multiplicity of vertically-applied solid lumber planks having a bead and cove detail. The panel 10 is shown in the figures as having a saw-textured, wood grain surface; however, it is within the contemplation of the invention to provide smooth surface panels. The critical feature of the present invention is not the particular texture of the plank area surfaces, but the provision of a panel having a realistic appearing simulation of solid wood planks having cove and bead detail which are suitably resistant to normal damaging stresses encountered in handling and shipment.

The front surface 12 of the panel 10 is configured with a plurality of adjacent areas 14 each of which simulates a vertical solid wood plank. On each area 14 there is a shallow cove recess 16 at one edge and a like cove recess 18 adjacent to a bead 20 at the opposite edge. As shown in FIG. 1, a plurality of these areas 14 are arranged such that the cove recess 16 of one edge of one area and the cove recess 18 adjacent the bead 20 of the next adjacent area 14 have their recessed surfaces facing the bead 20 of the next adjacent area 14. As shown, both of the coves 16 and 18 are separated from the bead 20 by narrow grooves 22. Each bead 20 extends upwardly from the base of grooves 22 on either side of the bead 20 such that its upper surface or crest is approximately tangential to the outermost plane of the front surface 12 of the panel 10.

The back surface 24 of the panel 10 is substantially planar. By this it is meant that there is no requirement for any particular rear surface detail according to the invention. It is intended, however, that the rear surface 24 can have whatever detail is conventional for non-facing hardboard panel surfaces. Thus, it is well recognized in the art that the rear surface of a hardboard panel can be randomly or non-randomly roughened to permit better adhesion with adhesives employed to fasten, position or seal the panel to a substrate.

Figure 3:
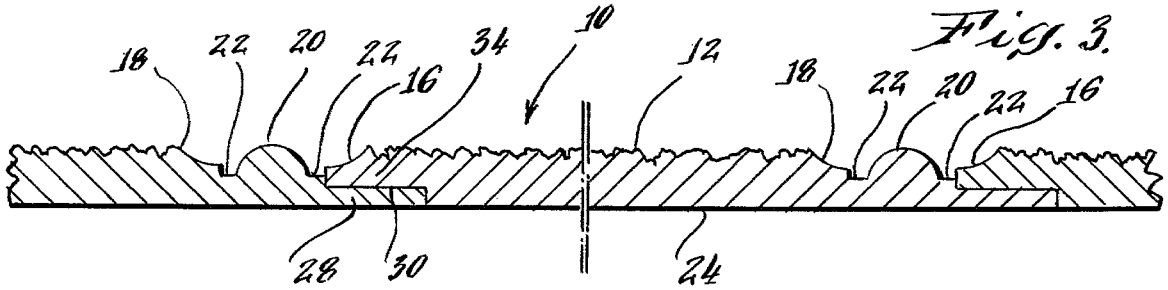
FIG. 3 shows the detail of the shiplap joints which mate the individual panels according to the present invention.

The panel has a first edge 26 of reduced thickness for forming the bottom lap 28 of a shiplap joint shown in cross section in FIG. 3. The back surface of the edge of reduced thickness 26 is a substantial continuation of the planar back surface 24. The front surface of the edge of reduced thickness 26 is recessed to a level below the base of a groove 22 which terminates the front surface configuration directly adjacent to the recessed area at the edge portion 26.

Similarly, a second edge of reduced thickness 32 is formed on the edge of the panel opposite the first edge 26. This second edge forms the top lap 34 of a shiplap joint as shown as 30 in FIG. 3. The back surface of the second edge 32 is recessed from the substantially planar back surface 24. The front surface of the second edge 32 is a substantial continuation of the front surface configuration and terminates with a recessed cove 16.

According to a preferred embodiment of the present invention, the detail of the first edge 26 and the second edge 32 and the associated cove and groove detail directly adjacent thereto are slightly differently dimensioned to make these vulnerable edges of the panels as thick as possible to minimize damage in shipping and handling. These differences in dimensional detail provide a desirable balance between the provision of maximum edge strength in a panel of this type and the overall appearance of the panel. Thus, according to this preferred embodiment, the cove 16 which terminates the front surface of the second edge 32 has a radius of curvature less than the coves 16 and 18 formed on the remainder of the panel. However, the linear extent of the cove 16 across the width of the panel 10 is substantially the same as for the coves 16 and 18 formed on the remainder of the panel 10, whereby the strength of the second edge 32 is improved while not adversely affecting the appearance of the bead and cove detail.

According to one preferred embodiment of the invention a panel is formed 48¾ inches in width with a series of 6 plank defining areas 14 each being approximately 8 inches in width. This configuration leaves ¾ of an inch for a first edge portion 26 for the shiplap joint. The second edge 32 opposite the first edge 26 has a recess extending ¾ of an inch across the back width of the panel. The panel itself has a 7/16 inch nominal thickness. The grooves 22 are formed to a depth of 3/16 of an inch, are 1/16 inch wide and border a 9/16 inch diameter bead 20 the upper surface of which is approximately tangential to the outermost plane of the front surface of the panel. The coves 16 and 18 are ¾ inch radius recesses which extend ⅛ of an inch in depth into the panel and ⅜ of an inch across the width of the panel. The cove recess 16 at the second edge 32 of the panel has a radius of curvature less than the radius of curvature of the other cove recesses. By this arrangement, the cove recess at the end of the second edge 32 still extends ⅜ of an inch along the width of the front surface 12 of the panel, however the depth of recess is less than the depth of the other cove recesses. The thickest area of the second edge 32 is 7/32 of an inch while the thinnest area at the extreme edge of the panel is 3/32 of an inch. Thus, in accordance with the subject invention, th shallower curve utilized to define the cove recess at the second edge 32 of the panel results in less material being removed from the panel leaving a thicker, less vulnerable edge area, which will not substantially change the appearance of the board. The first edge thickness is ⅛ of an inch. A panel of these desirable dimensions provides a realistic simulation of solid wood planks having a bead and cove detail, in combination with suitable strength for standing up to shipping and handling.

The hardboard panels of the present invention can be made according to conventional technology and are not limited in this regard; however, it is preferred for the best balance of strength, surface detail and integrity, and economy, to provide panels having a density of about 31 pounds per cubic foot or greater. Preferably, these panels are prepared from ligno-cellulosic fiber and will typically have a resinous binder such as phenol formaldehyde incorporated therein. The panels are typically formed by pressing under elevated temperature and pressure.

The above description is for the purpose of describing the invention to the person of ordinary skill in the art and it is not intended to detail all those obvious modifications and variations of it which will become apparent upon a reading. It is intended, however, that all such obvious modifications and variations be included within the scope of the present invention which is defined by the following claims.

What is claimed is:

1. An exterior grade hardboard siding panel for application to vertical surfaces to protect the surfaces from the weather and to provide the appearance of a multiplicity of vertically-applied solid lumber planks having a bead and cove detail, comprising a thin rectangular panel having:

(a) a front surface configured with a plurality of adjacent areas each simulating a vertical solid wood plank, wherein each area has a shallow cove recess at one edge and a like cove recess adjacent to a bead at the opposite edge, and said plurality of areas are arranged such that (i) the cove recess of one edge of one area and the cove recess adjacent to the bead of the next adjacent area have their recessed surfaces facing said bead of said next adjacent area, (ii) both said coves are separated from said bead by narrow grooves, and (iii) said bead extends upwardly from the base of said grooves to a crest which is approximately tangential to the outermost plane of the front surface;

(b) a substantially planar back surface;

(c) a first edge of reduced thickness forming the bottom lap of a shiplap joint the back surface of which is a continuation of said substantially planar back surface, and the front surface of which is recessed to a level below the base of a groove which terminates the front surface configuration directly adjacent to the recessed area; and (d) a second edge of reduced thickness opposite said first edge, forming the top lap of a shiplap joint, the back surface of which is recessed from said substantially planar back surface, and the front surface of which is a substantial continuation of the front surface configuration and terminates with a recessed cove, and wherein the radius of curvature of the cove which terminates the front surface of said second edge is less than the radius of curvature of the coves formed on the rest of said panel, and wherein the linear extent of all said coves, measured across the width of said panel, is substantially identical, whereby the strength of said second edge is improved, since less material is removed from said panel, while the appearance of the bead and cove detail is maintained.

* * * * *